US007766171B2

(12) United States Patent
Wakamiya et al.

(10) Patent No.: US 7,766,171 B2
(45) Date of Patent: Aug. 3, 2010

(54) RIGID STORAGE TRAY FOR FLAT AND LETTER MAIL

(75) Inventors: Stanley K. Wakamiya, Ellicott City, MD (US); Pierre J. Campagnolle, Elkridge, MD (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 119 days.

(21) Appl. No.: 12/039,211

(22) Filed: Feb. 28, 2008

(65) Prior Publication Data

US 2009/0218258 A1 Sep. 3, 2009

(51) Int. Cl.
*B07C 5/28* (2006.01)

(52) U.S. Cl. ..... 209/594; 209/584; 209/900

(58) Field of Classification Search ..... 209/594, 209/584, 900; 270/52.14, 52.16, 58.14, 58.16, 270/58.18, 58.29
See application file for complete search history.

(56) References Cited

U.S. PATENT DOCUMENTS

| | | | | |
|---|---|---|---|---|
| 3,343,725 | A | 9/1967 | Cannon | |
| 3,637,076 | A * | 1/1972 | Halopoff et al. | 209/704 |
| 4,446,962 | A | 5/1984 | Burkhardt | |
| 4,509,635 | A | 4/1985 | Emsley et al. | |
| 4,699,277 | A | 10/1987 | Baxter | |
| 4,725,182 | A | 2/1988 | Sakamoto et al. | |
| 4,730,730 | A | 3/1988 | Clarkson | |
| 4,757,985 | A | 7/1988 | Hamant et al. | |
| 4,863,037 | A | 9/1989 | Stevens et al. | |
| 4,895,242 | A | 1/1990 | Michel | |
| 5,044,877 | A | 9/1991 | Constant et al. | |
| 5,054,992 | A | 10/1991 | Hognestad et al. | |
| 5,104,109 | A | 4/1992 | Kubo | |
| 5,106,254 | A | 4/1992 | Tolasch et al. | |
| 5,119,954 | A | 6/1992 | Svyatsky et al. | |
| 5,183,378 | A | 2/1993 | Asano et al. | |
| 5,233,814 | A * | 8/1993 | Bergerioux et al. | 53/536 |
| 5,239,182 | A | 8/1993 | Tateyama et al. | |
| 5,244,199 | A | 9/1993 | Wood | |
| 5,266,812 | A | 11/1993 | Mokuo | |
| 5,273,392 | A | 12/1993 | Bernard, II et al. | |
| 5,290,025 | A | 3/1994 | Plent et al. | |
| 5,324,025 | A * | 6/1994 | Chadwick et al. | 271/306 |
| 5,340,100 | A | 8/1994 | Romanenko | |
| 5,360,316 | A | 11/1994 | O'Mara et al. | |
| 5,364,592 | A | 11/1994 | Lewis et al. | |

(Continued)

FOREIGN PATENT DOCUMENTS

| | | |
|---|---|---|
| DE | 42 40 158 C1 | 2/1994 |
| DE | 195 47 341 A1 | 11/1996 |
| WO | 86/06044 A1 | 10/1986 |

*Primary Examiner*—Patrick Mackey
*Assistant Examiner*—Michael E. Butler
(74) *Attorney, Agent, or Firm*—Rothwell, Figg, Ernst & Manbeck, P.C.

(57) ABSTRACT

A storage tray for storing mail items in the sorting outlets of a mail sorting machine having a carousel with buckets that hold mail items and move in a transport direction such that the mail items describe an arcuate path when released from the buckets. The storage tray includes a bottom surrounded by side walls defining a horizontal top portion of the tray and a horizontal bottom portion of the tray, wherein the bottom of the tray includes a landing wall and a jogging wall intersecting in the bottom portion of the tray, the landing wall extending from the jogging wall in a first direction towards the top portion of the tray at an angle relative to the horizontal bottom portion of the tray, and the jogging wall extending away from the landing wall in a second direction along a generally arcuate curved path toward the top portion of the tray. The shape of the jogging wall preferably corresponds generally to the path of a mail item released from a bucket carousel of a sorting machine.

9 Claims, 3 Drawing Sheets

Original RCT tray

U.S. PATENT DOCUMENTS 5,379,992 A 1/1995 Holmes et al.
5,419,457 A 5/1995 Ross et al.
5,535,874 A 7/1996 Ross et al.
5,593,269 A 1/1997 Bernard, II
5,636,723 A 6/1997 Bulle et al.
5,666,630 A 9/1997 Zoltner et al.
5,667,211 A * 9/1997 Reist ..... 270/52.16
5,692,867 A 12/1997 Kondo et al.
5,695,071 A 12/1997 Ross et al.
5,713,713 A 2/1998 Syde et al.
5,733,093 A 3/1998 Palm et al.
5,826,744 A 10/1998 Kwasniewski et al.
5,829,742 A 11/1998 Rabindran et al.
5,871,209 A 2/1999 Orchard et al.
5,897,290 A 4/1999 Lu et al.
5,906,468 A 5/1999 Vander Syde et al.
5,934,666 A 8/1999 Rabindran et al.
5,934,866 A 8/1999 Redden
5,957,448 A 9/1999 Frank et al.
5,964,564 A 10/1999 Hanon et al.
5,971,391 A 10/1999 Salomon et al.
5,980,188 A 11/1999 Ko et al.
5,993,132 A 11/1999 Harres et al.
6,024,533 A 2/2000 Redden
6,026,967 A 2/2000 Isaacs et al.
6,032,946 A 3/2000 Marshall et al.
6,054,666 A * 4/2000 Yamashita et al. ..... 209/583
6,095,316 A 8/2000 Redden
6,142,723 A 11/2000 Kang
6,172,355 B1 1/2001 Gast et al.
6,179,283 B1 1/2001 Gerstenberg et al.
6,217,020 B1 4/2001 Supron et al.
6,227,536 B1 5/2001 Bethke
6,270,070 B1 8/2001 Salomon et al.
6,276,509 B1 8/2001 Schuster et al.
6,354,587 B1 3/2002 Engarto
6,390,756 B1 5/2002 Isaacs et al.
6,431,369 B1 8/2002 Boller et al.
6,454,253 B1 9/2002 Tranquillla
6,503,044 B1 1/2003 Enenkel
6,511,062 B1 1/2003 Blackwell et al.
6,543,766 B2 4/2003 Neri et al.
6,561,339 B1 5/2003 Olson et al.
6,575,306 B1 6/2003 Schuster et al.
6,575,687 B2 6/2003 Bonora et al.
6,585,256 B2 7/2003 Blackwell et al.
6,601,847 B2 8/2003 Hendrickson et al.
6,612,565 B2 9/2003 Blackwell et al.
6,618,645 B2 9/2003 Bacchi et al.
6,619,647 B2 9/2003 Post et al.
6,629,691 B2 10/2003 Niiyama et al.
6,648,284 B2 11/2003 Caporali et al.
6,679,491 B2 1/2004 Luebben et al.
6,702,281 B2 3/2004 Post et al.
6,719,519 B2 4/2004 Liehs
6,749,193 B2 6/2004 Berdelle-Hilge et al.
6,799,938 B2 10/2004 Sperger
6,820,561 B2 11/2004 Soldavini et al.
6,921,875 B2 7/2005 Hanson
6,924,451 B2 8/2005 Hanson
6,953,906 B2 10/2005 Burns et al.
2006/0113362 A1 6/2006 Kara et al.

* cited by examiner

RIGID STORAGE TRAY FOR FLAT AND LETTER MAIL

CROSS REFERENCE TO RELATED APPLICATION

The present application is related to U.S. patent application Ser. No. 11/157,783, filed on Jun. 22, 2005, which is incorporated herein by reference.

BACKGROUND OF THE INVENTION

I. Field of the Invention

The present invention relates generally to the field of mail sorting and, more particularly, to a storage bin or tray for receiving and storing mail items, typically letters and flat pieces of mail, in a mail sorting machine having a bucket carousel.

II. Discussion of the Background Art

In modern mail sorting machines, mail items are conveyed by a bucket carousel above a plurality of storage bins or trays constituting sorting outlets of the sorting machine. The mail items are dropped from the buckets into the storage trays by opening the bottoms of the buckets, for example as shown in U.S. Pat. No. 5,290,025.

U.S. Pat. No. 6,648,284 discloses a storage tray for mail items dropped from a bucket carousel of a mail sorting machine. Storage trays of this type have a bottom constituted by a wall inclined between two diametrically opposite corners of the tray, enabling the mail items to be stacked in the bottom of the tray, and enabling the stack of mail items in the bottom of the tray to be held in position, more effectively than when the bottom of the tray is oriented horizontally or perpendicular to the side walls of the tray.

Unfortunately, with trays of the above type, the mail items (in particular open items like magazines) tend to bounce off a side wall of the tray before being jogged into alignment in the bottom of the tray. More specifically, a mail item dropped into the tray tends to turn before it is jogged against a side wall of the tray, which can be detrimental to the remainder of the mail sorting process. In addition, the stability of the stack, and thus how well it stays together, is guaranteed only for flat mail items that are homogeneous, even though current sorting machines are required to sort mail items that are heterogeneous, i.e., of widely differing sizes. Furthermore, the arrangement of such a tray does not make it possible for the stack of mail items to be extracted automatically from the storage tray, which can be necessary during unstacking operations at the inlet of the sorting machine.

Another type of storage bin, disclosed in U.S. Patent Application Publication No. 2006/0113362, and shown in FIG. 1 at 10, has a bottom comprising two walls 12 and 14 that are inclined relative to one another at an angle B to form a V-shape in cross-section. Referring to FIG. 2, it can be seen that each mail item 16 that leaves a bucket 18 follows a path b until it lands in the storage bin 10, with one of the two inclined walls constituting a jogging wall 14 for jogging the mail items into alignment in the bottom of the storage bin, and the other of the two inclined walls of the storage bin constituting a landing wall 12 for receiving the mail items in the bottom of the bin. The jogging wall 14 of the bin is inclined at an angle $\gamma$ relative to horizontal, such as to be substantially tangential to a point along the path b of the mail item and the landing wall 12 of the bin is inclined at an angle $\alpha$ relative to horizontal such that a mail item 16 lands flat on the landing wall.

While this latter type of bin offers some improvement in terms of preserving the sequence of mail items during automatic bin conveying and bin handling operations, certain extreme stacking conditions have been noted that can affect the quality of the mail stack in such a bin. Some of the conditions that can occur to the mail stack include curving, curling, folding, nesting, and flipping of the mail. These conditions can cause problems with downstream handling of the mail and can require human intervention in order to preserve the integrity of the output. Moreover, the probability of finding folded flimsy mail items is higher at the bottom of the stack in the bin than at the top of the bin because the mail item's leading edge will sometimes come in contact with the wall of the bin prior to contacting the previous mail item.

More specifically, as illustrated in FIG. 2, the average drop path b of a mail item 16 released from a bucket 18 of a mail sorting carousel 20 does not follow the slope of the jogging wall 14. After passing the top edge of the bin 10, the leading edge of the mail item 16 moves away from the wall 14. This relationship between the average drop path and the jogging wall increases the probability of having curved or curled mail items in the stack. The inventors have found that, at the bottom of the stack, the probability of finding flimsy mail items in a folded condition is greater than at the top of the stack, possibly due to variations in the motion of specific mail items within the gap between the average drop path b and the jogging wall 14. In the case of a flats sorting system, the amount of mail items that are bound or stapled is much greater than in the case of a first class mail sorting system. So the average thickness of flats mail is bigger at the binding side than the open side, which further increases the probability of curved mail, as the mail binding edge of some flats mail touches the wall outside the relative mail/wall friction cone, and as the stack height gets bigger. In other words, the probability of curved mail items appears to increase with the height of the mail stack.

SUMMARY OF THE INVENTION

It is an object of the present invention to overcome one or more of the above-mentioned drawbacks by providing a mail storage tray for a sorting system that takes advantage of the average mail drop path to improve the condition of the mail stack in the tray, thereby facilitating automated tray handling and unloading operations.

To this end, the invention provides a storage tray for storing mail items in the sorting outlets of a mail sorting machine having a carousel with buckets that hold mail items and move in a transport direction such that the mail items describe an arcuate path when released from the buckets. The storage tray includes a bottom surrounded by side walls defining a horizontal top portion of the tray and a horizontal bottom portion of the tray, wherein the bottom of the tray includes a landing wall and a jogging wall intersecting in the bottom portion of the tray, the landing wall extending from the jogging wall in a first direction towards the top portion of the tray at an angle relative to the horizontal bottom portion of the tray, and the jogging wall extending away from the landing wall in a second direction along a generally curved path toward the top portion of the tray. The shape of the jogging wall preferably corresponds generally to the average path of a mail item released from a bucket carousel of a sorting machine.

In a particular embodiment of the storage tray, the jogging wall is made up of multiple segments arranged at angles relative to one another to approximate a parabolic shape.

In yet another particular embodiment of the storage tray, a first segment of the jogging wall intersects the landing wall at an angle of inclination that is preferably greater than 70 degrees relative to the horizontal bottom portion of the tray and, more preferably, between about 75 degrees and about 85 degrees.

In yet another particular embodiment of the storage tray, upper edges of the landing wall and the jogging wall are preferably offset vertically and, more preferably, an upper edge of the first segment extends at least as high as an upper edge of the landing wall.

The invention also provides a mail sorting system having a carousel with buckets that hold mail items and move in a transport direction such that the mail items describe an arcuate path when released from the buckets and a plurality of mail storage trays in stationary positions beneath the mail bucket carousel. In this aspect of the invention, each of the storage trays includes a bottom surrounded by side walls defining a horizontal top portion of the tray and a horizontal bottom portion of the tray, wherein the bottom of the tray includes a landing wall and a jogging wall intersecting in the bottom portion of the tray, the landing wall extending from the jogging wall in a first direction towards the top portion of the tray at an angle relative to the horizontal bottom portion of the tray, and the jogging wall extending away from the landing wall in a second direction along a generally curved path toward the top portion of the tray. The shape of the jogging wall preferably corresponds generally to the average path of a mail item released from a bucket carousel of a sorting machine.

In a particular embodiment of the mail sorting system, the jogging wall is made up of multiple segments arranged at angles relative to one another to approximate a parabolic shape.

In yet another particular embodiment, a first segment of the jogging wall intersects the landing wall at an angle of inclination that is preferably greater than 70 degrees relative to the horizontal bottom portion of the tray and, more preferably, between about 75 degrees and about 85 degrees.

In yet another particular embodiment, upper edges of the landing wall and the jogging wall are preferably offset vertically and, more preferably, an upper edge of the first segment extends at least as high as an upper edge of the landing wall.

Other objects and advantages of the present invention will become apparent to those of skill in the art as the description that now follows is read in conjunction with the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
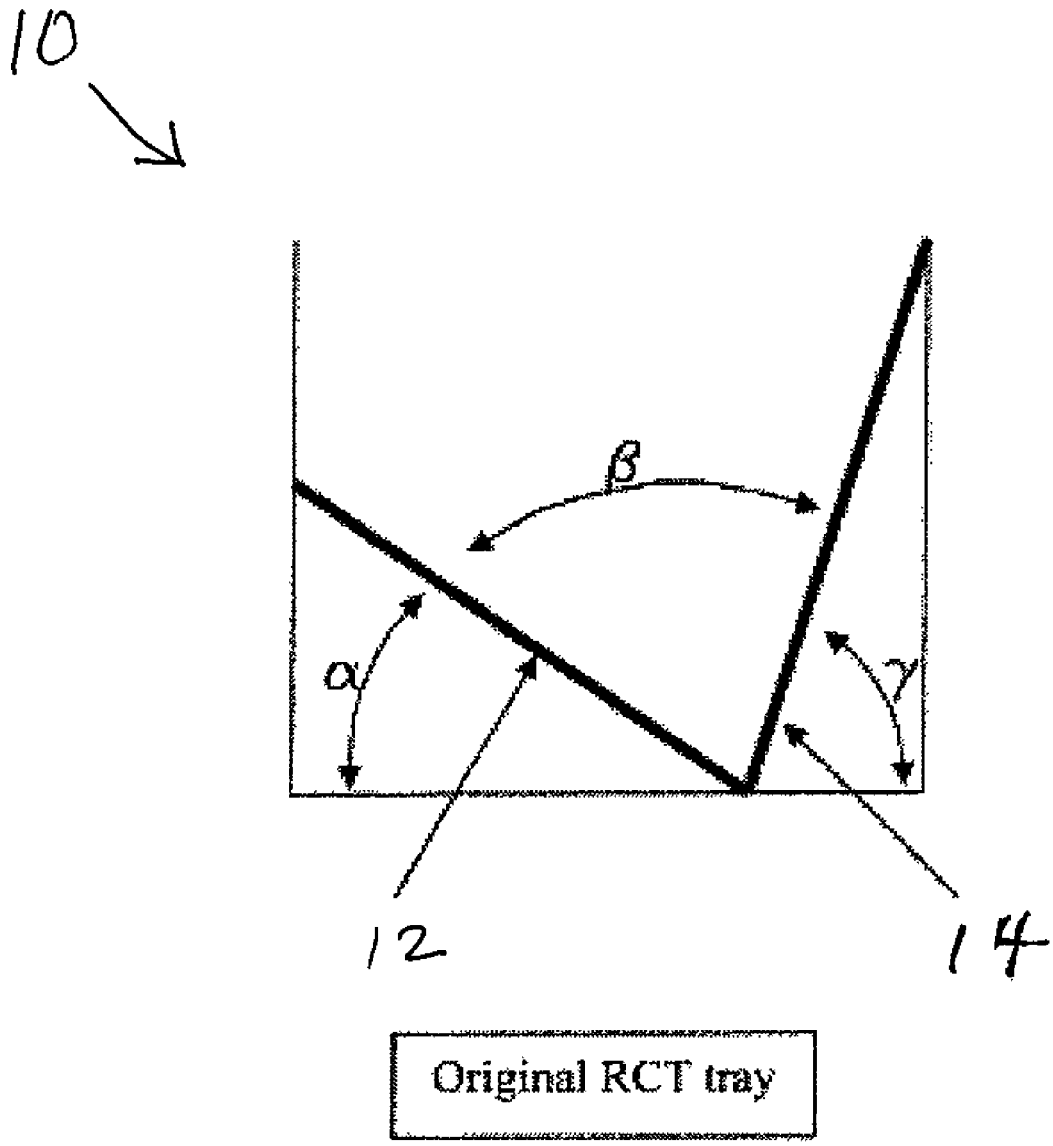
FIG. 1 is a cross-sectional side view of a storage tray for receiving a mail item from a bucket carousel of a mail sorting machine.
Figure 2:
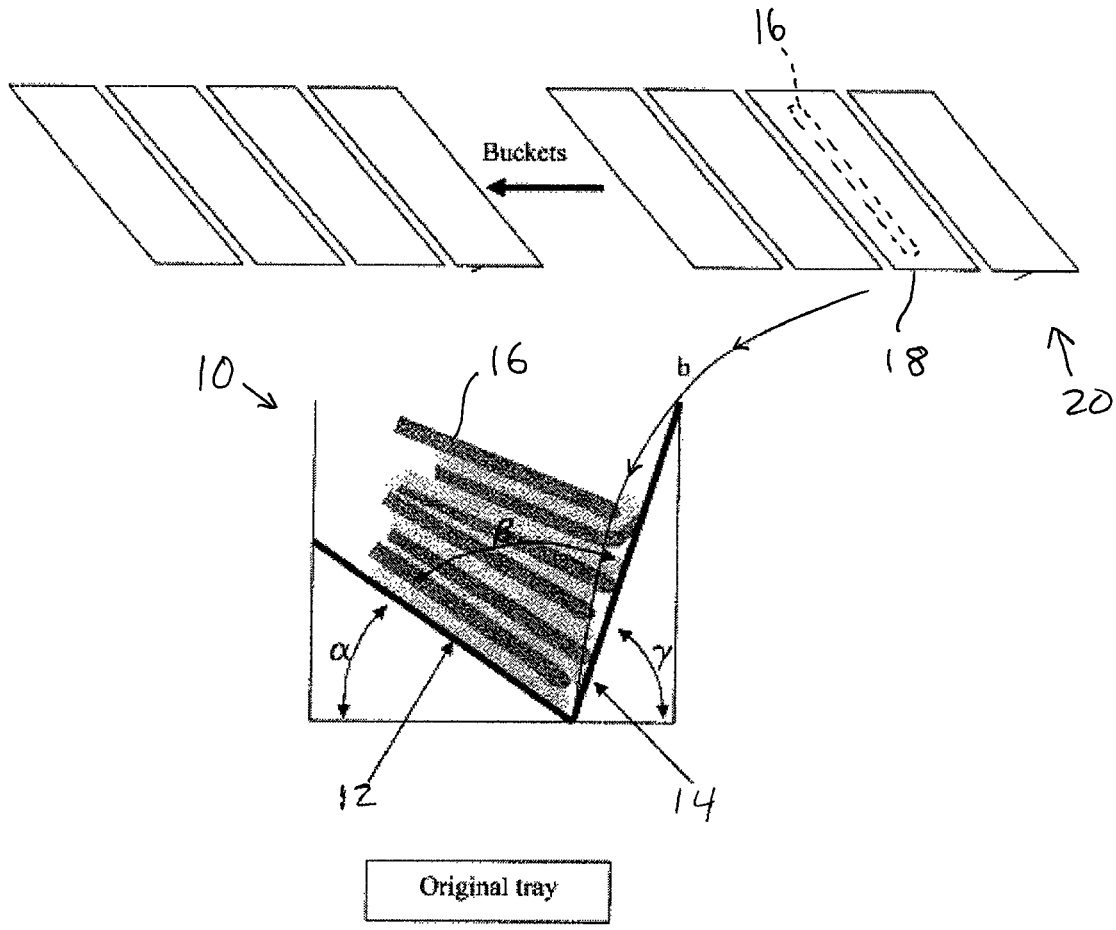
FIG. 2 is a cross-sectional side view of a mail storage tray in relation to the bucket carousel of a mail sorting machine.
Figure 3:
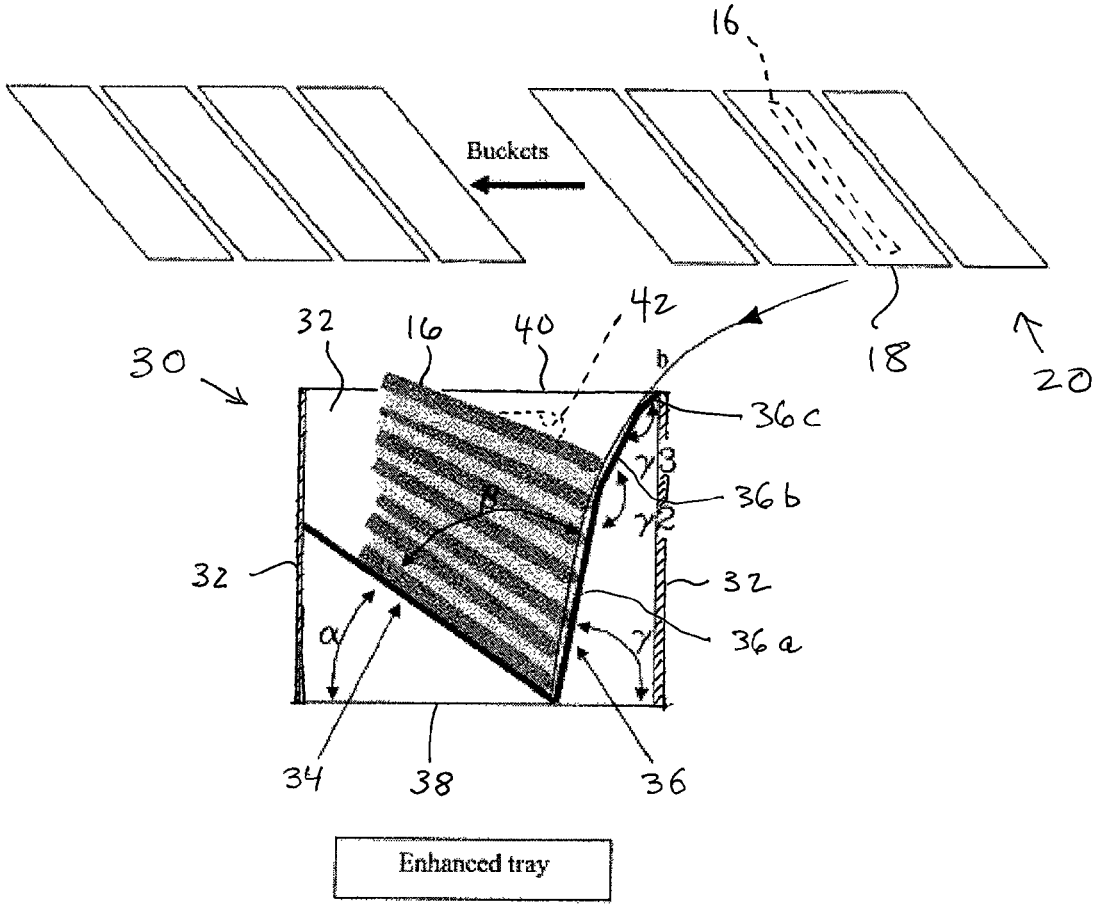
FIG. 3 is a cross-sectional side view of a mail storage tray according to the present invention in relation to the bucket carousel of a mail sorting machine according to the present invention.

FIG. 3 shows a storage bin or tray 30 according to the present invention positioned to receive mail items at an outlet of a mail sorting machine. The mail sorting machine includes a carousel 20 of conventional design made up of a plurality of inclined buckets 18 and a plurality of mail storage trays 30 according to the present invention positioned beneath the buckets.

The mail storage tray 30 is a box-like container made up of four side walls 32 surrounding a bottom of the tray. The bottom of the tray 30 is made up of two walls—a landing wall 34 and a jogging wall 36—that intersect at or near a horizontal bottom portion 38 of the tray. The landing wall 34 extends from the jogging wall 36 in a first direction towards a top portion 40 of the tray 30 at an angle $\alpha$ relative to the horizontal bottom portion 38 of the tray. The jogging wall 36 extends away from the landing wall 34 in a second direction along a curved path towards the top portion 40 of the tray 30.

In operation, a mail item 16 fed into the mail sorting machine at a feeder station (not shown) is deposited lengthwise into a bucket and conveyed in the bucket 18 toward a specific mail storage tray 30 based on addressee information. The mail item 16 is held substantially upright in the bucket 18 at a certain angle of inclination matching the angle of inclination of the bucket. For example, looking at FIG. 3, the bucket 18 and the mail item 16 can be oriented at an angle of about 60° clockwise relative to the horizontal.

The buckets 18 move on the carousel 20 at a predetermined speed, e.g., at about 1 meter per second (1 m/s). FIG. 3 shows a horizontal arrow going from right to left in order to indicate the direction of movement of the buckets 18 above the stationary mail storage trays 30.

As the bucket 18 containing a mail item 16 approaches the stationary tray 30, the bottom of the bucket opens and the mail item drops out of the bucket. The forward momentum of the mail item 16 and the influence of gravity causes the mail item to describe a path that is substantially parabolic, as shown by the dashed line labeled "b" in FIG. 3. For a range of mail items of weights lying in the range less than 10 grams (g) to 3 kilograms (kg), approximately, and of widths lying in the range 90 millimeters (mm) to 300 mm, approximately, and of lengths lying in the range 100 mm to 400 mm, approximately, the path of the mail item 16 remains mainly dependent on the angular position and on the travel speed of the bucket 18.

In an embodiment of the present invention, the landing wall 34 is oriented generally or almost parallel to the major plane of the bucket 16 and the jogging wall 36 is made up of segments that, together, describe a generally parabolic path corresponding substantially to the average parabolic path of a mail item dropped from a bucket. More specifically, the jogging wall includes a plurality of straight segments 36*a, b* and *c* oriented to define a generally parabolic shape in cross-section. A first segment 36*a* of the jogging wall 36 extends from the landing wall 34 at a first angle $\gamma$ relative to the horizontal lower portion 38 of the tray in a counterclockwise direction looking at FIG. 3, a second segment 36*b* of the jogging wall extends rearwardly from the first segment at a second angle $\gamma_2$ relative to the first segment, and a third segment 36*c* of the jogging wall extends from the second segment at an angle $\gamma_3$ relative to the second segment. The first angle $\gamma$ is preferably somewhat larger than the angle of the jogging wall described in U.S. Patent Application Publication No. 2006/0113362. In an embodiment, the first segment 36*a* of the jogging wall 36 of the present invention is oriented at a first angle $\gamma$ greater than 70°, preferably between about 75° and 80°, relative to the horizontal lower portion of the tray. The second and third segments 36*b* and *c* of the jogging wall 36 are oriented at successively smaller angles relative to the horizontal portion of the tray to describe a generally parabolic shape. The landing wall 34 is preferably oriented at about 40° clockwise relative to the horizontal lower portion of the tray.

Referring still to FIG. 3, it can be seen that, with such an arrangement, the mail item 16 lands flat against the landing wall 34 without its angular position being modified, and it jogs against the segmented jogging wall 36 without rising up towards the top of the bin so that it is possible to form a stack of mail items that is stable and that stays together in the bottom of the tray 30, which tray can be conveyed automatically or can be handled without any risk of the stack falling apart. In addition, the mail items 16 are stacked on edge in the bottom of the tray 30, thereby making it easy to check the contents of the storage tray.

Referring still to FIG. 3, it will be appreciated that, with the mail storage tray 30 of the present invention, the average mail drop path b, falling down into the tray, closely follows the slope of the segmented jogging wall 36 such that the leading edge of each mail item 16 stays close to, or even slightly touches, the wall during its fall into the tray. The tendency of the mail item 16 to curl or become curved is significantly reduced in comparison with the original design. Moreover, at the beginning of the stack, and due to the steeper angle $\gamma$ of the jogging wall in comparison to the original design, the leading edges of flimsy mail items do not fold because there is no excess pressure exerted by the wall. The present invention improves performance with flats mail too because the larger angle of the jogging wall reduces frictional forces that interfere with proper stacking of the items.

While a preferred embodiment of the invention has been described herein, it will be appreciated by those skilled in the art that various modifications and changes can be made without departing from the spirit and scope of the invention as claimed. For example, while a multi-segmented jogging wall with three segments forming an approximation of a parabolic arc is shown, it will be appreciated that any number of segments can be used to define a generally parabolic shape in cross-section. While the jogging wall can be smoothly curved, it is preferred to form the wall using a plurality of straight segments to reduce the probability of imparting a curvature to the mail as the tray fills. It will also be appreciated that one or both of the jogging wall and the landing wall can have a crenellated shape in profile, or have a plurality of slots formed therein, e.g., as shown in U.S. patent application Ser. No. 11/157,783 referenced above, to make it possible to use a device constituted by extraction fingers (not shown in the figures) to pass under the stack of heterogeneous mail items and thus to extract the mail items while also keeping the stack together. The example of the automatic or manual extraction process can be implemented between the first sorting pass and the second sorting pass in the sorting machine, or during transfer from the storage tray to another bin or tray dedicated to delivery. In a particular embodiment of the storage tray of the invention, a bar code is written on the storage tray in order to identify it, and in order to make it possible to monitor the sequence of the storage bins in the sorting machine.

In a particular embodiment of the storage tray of the invention, the tray is made up of four side walls oriented perpendicular to one another to define upper and lower horizontal portions of the tray. In yet another particular embodiment, shown by broken lines at 42 in FIG. 3, hand holds are formed on one or more of the side walls to facilitate manual transport and handling of the trays. For example, horizontal slots can be formed in the side walls adjacent lateral edges of the jogging and landing walls as shown in U.S. patent application Ser. No. 11/157,783. In another embodiment of the storage tray of the invention, the side walls flare inwardly from the open top to the closed bottom so that, when the trays are not in use, they can be stacked by nesting in one another, thereby minimizing the amount of space required for storage.

In yet another particular embodiment of the storage tray of the invention, the bottom of the storage tray made up by the landing wall and the jogging wall is configured as a removable insert suitable for placement at the bottom of a storage bin or tray having a flat bottom, for example.

The specification and drawings are, accordingly, to be regarded in an illustrative rather than a restrictive sense, the invention being limited only by the appended claims.

The invention claimed is:

1. A mail sorting system comprising:

a plurality of buckets mounted on a carousel for movement in a transport direction, wherein said buckets are oriented at an angle relative to the transport direction; and a plurality of mail storage trays located at stationary positions beneath said buckets, wherein each tray includes a bottom surrounded by side walls defining a horizontal top portion of said tray and a horizontal bottom portion of said tray, wherein said bottom of said tray includes a landing wall and a jogging wall intersecting in said bottom portion of said tray, said landing wall extending from said jogging wall in a first direction towards said top portion of said tray at an angle relative to said horizontal bottom portion of said tray, and said jogging wall extending away from said landing wall in a second direction along a curved path toward said top portion of said tray.

2. The mail sorting system of claim 1, wherein said curved path of said jogging wall of said mail storage tray corresponds generally to the path of a mail item released from one of said buckets.

3. The mail sorting system of claim 1, wherein said jogging wall of said mail storage tray includes a first segment extending from said landing wall at a first angle relative to said horizontal bottom portion of said tray to a second segment of said jogging wall oriented at a second angle less than said first angle.

4. The mail sorting system of claim 3, wherein said jogging wall of said mail storage tray further includes a third segment extending from said second segment to said second side wall at a third angle less than said second angle.

5. The mail sorting system of claim 1, wherein said angle of inclination of said landing wall of said mail storage tray is about 40 degrees.

6. The mail sorting system of claim 3, wherein said first angle of inclination of said first segment of said jogging wall of said mail storage tray is greater than 70 degrees.

7. The mail sorting system of claim 6, wherein said first angle of inclination of said first segment of said jogging wall of said mail storage tray is between about 75 degrees and about 85 degrees.

8. The mail sorting system of claim 1, wherein upper edges of said landing wall and said jogging wall are offset vertically.

9. The mail sorting system of claim 3, wherein an upper edge of said first segment of said jogging wall extends at least as high in a vertical direction as an upper edge of said landing wall.

* * * * *